US006520332B1

(12) United States Patent
Barmore et al.

(10) Patent No.: US 6,520,332 B1
(45) Date of Patent: Feb. 18, 2003

(54) PACKAGING CUSHION AND PACKAGING ASSEMBLIES INCORPORATING SAME

(75) Inventors: Charles Rice Barmore, Moore, SC (US); Kenneth Paul Chrisman, Monroe, CT (US); Stephen Floyd Compton, Spartanburg, SC (US); Steve B. Garland, Greenville, SC (US); Alan S. Weinberg, Taylors, SC (US); George Dean Wofford, Duncan, SC (US)

(73) Assignee: Cryovac, Inc., Duncan, SC (US)

( * ) Notice: Subject to any disclaimer, the term of this patent is extended or adjusted under 35 U.S.C. 154(b) by 0 days.

(21) Appl. No.: 09/437,411

(22) Filed: Nov. 10, 1999

(51) Int. Cl.[7] ..... B65D 81/05

(52) U.S. Cl. ..... 206/522; 53/398; 206/497; 206/499; 206/523; 206/589

(58) Field of Search ..... 206/150, 497, 206/499, 521, 522, 523, 588, 589, 590, 562, 563, 778; 428/108, 35.2; 53/398, 399; 114/345; 441/40, 81; 472/134

(56) References Cited

U.S. PATENT DOCUMENTS

| | | | | | |
|---|---|---|---|---|---|
| 1,457,496 | A | | 6/1923 | Butler | |
| 1,499,369 | A | * | 7/1924 | Holland | 206/499 |
| 2,796,979 | A | * | 6/1957 | Buttery | 206/499 |
| 3,089,153 | A | | 5/1963 | Bosc | 5/348 |
| 3,226,285 | A | * | 12/1965 | Iovenko | 428/108 |
| 3,346,101 | A | | 10/1967 | Pestka | 206/522 |
| 3,366,231 | A | | 1/1968 | Trakas | 206/65 |
| 3,398,501 | A | | 8/1968 | Aninger | 206/522 |
| 3,451,536 | A | * | 6/1969 | O'Leary et al. | 206/778 |
| 3,889,743 | A | | 6/1975 | Presnick | 165/46 |
| 4,235,065 | A | | 11/1980 | Freeman | 53/472 |
| 4,739,884 | A | | 4/1988 | Duplessy | 206/499 |
| 4,779,731 | A | * | 10/1988 | Fujio | 206/497 |
| 4,874,093 | A | | 10/1989 | Pharo | 206/522 |
| 4,905,835 | A | | 3/1990 | Pivert et al. | 206/522 |
| 4,979,620 | A | | 12/1990 | Delamare et al. | 206/594 |
| 5,005,702 | A | | 4/1991 | Davis et al. | 206/562 |
| 5,134,930 | A | | 8/1992 | Mei-Hwa | 108/42 |
| 5,139,153 | A | | 8/1992 | Delamare et al. | 206/594 |
| 5,154,289 | A | * | 10/1992 | Van Erden | 206/150 |
| 5,180,060 | A | | 1/1993 | Forti et al. | 206/522 |
| 5,348,157 | A | | 9/1994 | Pozzo | 206/522 |
| 5,351,829 | A | | 10/1994 | Batsford | 206/522 |
| 5,445,274 | A | | 8/1995 | Pharo | 206/522 |
| 5,454,642 | A | | 10/1995 | De Luca | 383/3 |
| 5,469,966 | A | | 11/1995 | Boyer | 206/522 |
| 5,570,788 | A | | 11/1996 | Batsford | 206/522 |
| 5,588,533 | A | | 12/1996 | Farison et al. | 206/522 |
| 5,620,096 | A | | 4/1997 | Pozzo | 206/450 |
| 5,622,262 | A | | 4/1997 | Sadow | 206/522 |
| 5,626,229 | A | | 5/1997 | Dickie et al. | 206/522 |
| 5,628,402 | A | | 5/1997 | Dickie et al. | 206/521 |
| 5,634,555 | A | | 6/1997 | Dunham | 206/19 |
| 5,727,270 | A | | 3/1998 | Cope et al. | 5/710 |
| 5,755,329 | A | | 5/1998 | Sadow | 206/522 |
| 5,762,197 | A | | 6/1998 | Farison | 206/522 |
| 5,803,263 | A | | 9/1998 | Pozzo | 206/522 |
| 5,819,942 | A | | 10/1998 | Sadow | 206/522 |
| 5,830,780 | A | | 11/1998 | Dennison et al. | 128/68 |
| 5,846,620 | A | | 12/1998 | Compton | 428/35.7 |
| 5,862,914 | A | | 1/1999 | Farison et al. | 206/522 |

FOREIGN PATENT DOCUMENTS

| | | |
|---|---|---|
| FR | 1.371.316 | 7/1964 |
| FR | 2.385.606 | 10/1978 |
| WO | WO 96/22926 | 8/1996 |

* cited by examiner

*Primary Examiner*—Jim Foster
(74) *Attorney, Agent, or Firm*—Lerner, David, Littenberg, Krumholz & Mentlik, LLP

(57) ABSTRACT

A packaging cushion is disclosed for supporting and protecting objects during shipment. The cushion has upper and lower surfaces and one or more compartments for supporting the objects in positions so that the objects are higher than the lower surfaces of the cushions. The cushions may include upper and lower nodes which increase the separation distance between the objects when the cushions are stacked one on top of another. The cushions may be held in a stack by an outer box, or by wrapping the stack of cushions in a protective film, eliminating the need for an outer box.

44 Claims, 8 Drawing Sheets

PACKAGING CUSHION AND PACKAGING ASSEMBLIES INCORPORATING SAME

FIELD OF THE INVENTION

The present invention relates to packaging materials and, more particularly, to packaging cushions. Still more particularly, the present invention relates to inflatable packaging cushions which may be stacked in layers to protect articles packaged between the layers.

BACKGROUND OF THE INVENTION

Protective packaging materials are commonly used to cushion a wide variety of products during shipping. One product which presents particular difficulties is the shipping of meat packaged for retail sale. These meat packages are often prepared at a processing facility and shipped to multiple retail outlets for sale. In a typical arrangement, portions of meat are packaged in a molded polystyrene tray having a flange projecting laterally from the top edge of the tray. One or more plastic films are heat-sealed to the flange to seal the meat within a protective atmosphere. A quantity of individual packages are then assembled in an outer box for shipping.

During the shipping of these meat packages, it is critical that the packages do not become damaged in any way. Damage to the tray, film or the tray/film seal may result in contamination of the packaged product and, for health reasons, require the package and its contents to be discarded. Furthermore, damage to the tray, film or tray/film seal may cause a loss of the protective atmosphere, resulting in rapid spoilage of the product.

One arrangement for protecting these packages during shipping utilizes corrugated cardboard dividers to separate multiple layers from one another, as well as to separate individual packages within each layer. In such arrangement, interlocking corrugated cardboard dividers extending in the length and width directions of an outer box divide each layer of the box into cells, each of which receives one package of meat. A sheet of corrugated cardboard is placed over the first layer, and a second layer of dividers is inserted into the box for receiving another layer of packaged meat. Each layer of dividers is sized to be higher than the meat packages so that an air space is created above the packages in each layer. The corrugated cardboard dividers have good strength in the vertical direction of the box, and therefore satisfactorily protect the meat packages from vertical forces, such as compressive forces caused by stacking the boxes or impact forces resulting from dropping the boxes vertically onto their bottoms. However, these dividers do not adequately protect against forces having components in the horizontal direction. Thus, forces resulting from dropping a box on a side, end or corner, or from sliding a box into a fixed object, cause the trays to slide, whereupon their flanges may contact the dividers or the side of the box, frequently resulting in damage to the package.

There therefore exists a need for improved packaging materials which will enable prepackaged meats and other products to be shipped in quantity without damage. Preferably, such packaging materials will be inexpensive, easy to use and stored in a minimum of space prior to use.

SUMMARY OF THE INVENTION

The present invention addresses these needs.

One aspect of the present invention provides a packaging cushion for holding at least one tray having a bottom, outwardly-sloping sidewalls and a top edge. The packaging cushion may include one or more ring elements extending generally in a horizontal plane, the ring elements defining one or more openings. The ring elements have top and bottom surfaces and interior side surfaces facing toward the one or more openings. The interior side surfaces of the ring elements are adapted to engage the sidewalls of the tray to support the tray in a suspended position. Preferably, the interior side surfaces of the ring elements have a substantially cylindrical contour.

The cross-sectional size of all of the ring elements may be about the same. Alternatively, a first group of the ring elements may have a cross-sectional size which is substantially less than the cross-sectional size of a second group of the ring elements. The ring elements in the first group preferably are disposed between adjacent ones of the openings.

The ring elements may define one or more rows of openings, the openings in each row being separated by a first group of the ring elements. Where the ring elements define two or more rows of openings, the openings in one row may be separated from the openings in another row by a second group of ring elements. The second group of ring elements may have a cross-sectional size which is greater than the cross-sectional size of the ring elements in the first group.

In preferred embodiments, the ring elements may be formed from a resilient material. In this regard, the ring elements may include a hollow chamber at least partially filled with a filler material, preferably air. The packaging cushion in accordance with these preferred embodiments may further include a valve member defining an opening for supplying the filler medium to an interior of the chamber.

In highly preferred embodiments, the packaging cushion may further include a plurality of upper nodes projecting upwardly from the ring elements at spaced-apart locations, the upper nodes having top surfaces disposed higher than the top surfaces of the ring elements. In accordance with these embodiments, the interior side surfaces of the ring elements may be adapted to engage the sidewalls of the tray so that the top edge of the tray lies higher than the top surfaces of the ring elements and lower than the top surfaces of the upper nodes. The top surfaces of the upper nodes may be at substantially the same height.

In other highly preferred embodiments, the packaging cushion may further include a plurality of lower nodes projecting downwardly from the ring elements at spaced-apart locations, the lower nodes having bottom surfaces disposed lower than the bottom surfaces of the ring elements. In accordance with these embodiments, the ring elements may be adapted to engage the sidewalls of the tray so that the bottom of the tray lies lower than the bottom surfaces of the ring elements and higher than the bottom surfaces of the lower nodes. The bottom surfaces of the lower nodes may be at substantially the same height.

Each of the upper nodes in these embodiments may be substantially aligned over a lower node to define a plurality of node pairs. For each node pair, the top surface of the upper node may be spaced from the bottom surface of the lower node by a separation distance, the separation distance for each node pair being about the same.

Another aspect of the present invention provides a cushion for holding at least one object. The cushion may include one or more ring elements extending generally in a horizontal plane and having top and bottom surfaces, the ring elements defining one or more openings. At least one web of material may be positioned in the openings to divide the openings into upper and lower pockets. A plurality of upper nodes may project upwardly from the ring elements at spaced-apart locations, and a plurality of lower nodes may project downwardly from the ring elements at spaced-apart locations. The,upper and lower nodes may be aligned with one another to define a plurality of node pairs. The top surface of the upper node in a node pair may be spaced from the bottom surface of the lower node in the node pair by a separation distance, which separation distance for each node pair preferably is about the same.

A further aspect of the present invention provides a packaging assembly. The packaging assembly may include a packaging cushion having any of the structural features described above, and at least one tray having a bottom, outwardly-sloping sidewalls and a top edge. The tray may be assembled in one of the openings in the packaging cushion with the interior side surfaces of the ring elements engaging the sidewalls of the tray to support the tray in a suspended position. Embodiments of the packaging assembly may include a plurality of trays having a bottom, outwardly-sloping sidewalls, a top edge and a flange projecting outwardly from the top edge. The trays may be assembled in cushions in which the ring elements disposed between adjacent openings are smaller in cross-sectional size than the remainder of the ring elements. The trays may be assembled in the openings in these cushions so that the flange of one tray overlaps with the flange of an adjacent tray.

Yet a further aspect of the present invention provides a packaging assembly for holding at least one article. The packaging assembly may include a cushion having one or more ring elements extending generally in a horizontal plane and having top and bottom surfaces, the ring elements defining one or more openings. At least one web of material may be positioned in the openings to divide the openings into upper and lower pockets. At least one object may be assembled in the upper pocket so that the object is supported at a position higher than the bottom surfaces of the ring elements.

In preferred embodiments hereof, a plurality of apertures or a plurality of slits may be formed in the web of material. In highly preferred embodiments, the packaging assembly may further include at least one slit dividing the web of material into first and second portions, and the at least one object may be supported in the upper pocket between these first and second portions.

A still further aspect of the present invention provides a shipping package. Embodiments of the shipping package may include a plurality of cushions, each cushion having upper and lower surfaces and one or more compartments. At least one object may be assembled in the compartments so that the object is supported at a position higher than the lower surface of the cushion in which it is assembled. The cushions may be arranged one on top of another to form a stack, and an outer container may be assembled around the stack to hold the stack in assembled relationship. Preferably, the compartments in each of the cushions in the stack confront corresponding compartments in an adjacent cushion to define packaging cells, whereby the object is assembled in the packaging cells.

In preferred embodiments of these shipping packages, the outer container may include a box or a securing material wrapped around the stack. A handle may be connected to the securing material. The securing material may include a film material wrapped around the sides of the stack, and preferably around the top and bottom ends of the stack as well. Preferred film materials are mono- or multi-layer thermoplastic polymer films having a high degree of puncture and abuse resistance. Preferably, such films are shrinkable to form a tight engagement around the stack. A stabilizing layer may be positioned between the uppermost and/or lowermost cushion in the stack and the securing material.

Other embodiments of the shipping package may include a plurality of cushions, each cushion including one or more ring elements extending generally in a horizontal plane and having top and bottom surfaces, the ring elements defining one or more compartments. At least one object is assembled in the compartments so that the object is supported at a position higher than the bottom surfaces of the ring elements. The cushions may be arranged one on top of another to form a stack, and an outer container may be assembled around the stack to hold the stack in assembled relationship. The compartments in each of the cushions may confront corresponding compartments in an adjacent cushion to define packaging cells, whereby the object is assembled in the packaging cells.

Preferred embodiments of these shipping packages may further include at least one web of material positioned in each of the compartments to divide the compartments into upper and lower pockets, wherein the object is supported in the upper pockets on the webs of material. The webs of material may include a plurality of apertures or slits formed therein. Additionally, each web of material may include at least one slit dividing the web into first and second portions, wherein the object may be supported in the upper pocket between the first and second portions of the web.

In a highly preferred embodiment hereof, the shipping package may include first and second webs of material positioned in each compartment to divide the compartment into upper and lower pockets, the first web of material confronting the second web of material to define a space therebetween. One of the first and second webs of material may include a slit providing access to the space, and the object may be assembled in the space.

Still another aspect of the present invention provides methods of packaging at least one tray having a bottom, outwardly-sloping sidewalls and a top edge. In accordance with these methods, a cushion as described above may be provided, and the tray may be positioned in one of the openings in the cushion to form an assembly in which the interior side surfaces of the ring elements engage the sidewalls of the tray to support the tray in a suspended position.

In embodiments in which the cushion is provided with a plurality of upper nodes projecting upwardly from the ring elements at spaced-apart locations, the positioning step may include the step of positioning the tray so that the top edge of the tray in the suspended position lies higher than the top surfaces of the ring elements and lower than the top surfaces of the upper nodes. In embodiments in which the cushion is provided with a plurality of lower nodes projecting downwardly from the ring elements at spaced-apart locations, the positioning step may include the step of positioning the tray so that the bottom of the tray in the suspended position lies lower than the bottom surfaces of the ring elements and higher than the bottom surfaces of the lower nodes.

Preferred methods may further include the step of at least partially surrounding the assembly with an outer container to hold the tray and the cushion in assembled relationship. The surrounding step may include the step of wrapping a film material around the assembly. Highly preferred methods may further include the step of connecting at least one handle to the film material.

A still further aspect of the present invention provides methods of packaging objects. In accordance with these methods, a plurality of cushions may be provided, each cushion having upper and lower surfaces and one or more compartments. The objects may be assembled in the compartments so that the objects are supported at positions higher than the lower surfaces of the cushion in which they are assembled. The cushions may be arranged one on top of another to form a stack, and the stack may be at least partially surrounded with an outer container to hold the stack in assembled relationship. In a preferred arrangement, the cushions may be arranged so that the compartments in each of the cushions confront corresponding compartments in adjacent cushions to define packaging cells, and the object may be assembled in the packaging cells.

In preferred methods in accordance with this aspect of the invention, the cushions may be provided with a plurality of upper nodes projecting upwardly from the upper surfaces of the cushions at spaced-apart locations, and a plurality of lower nodes projecting downwardly from the lower surfaces of the cushions at spaced-apart locations. In each cushion, the upper nodes may be substantially aligned over corresponding lower nodes to define a plurality of node pairs. The cushions may be arranged so that the node pairs in each cushion are substantially aligned with corresponding node pairs in adjacent cushions.

In highly preferred methods, the surrounding step may include the step of wrapping a film material, preferably a mono- or multi-layer thermoplastic polymer film, around the stack. In addition, a stabilizing layer may be positioned between the uppermost and/or lowermost cushion in the stack and the film material. These methods may also include the step of connecting at least one handle to the film material.

BRIEF DESCRIPTION OF THE DRAWINGS

A more complete appreciation of the subject matter of the present invention and the various advantages thereof can be realized by reference to the following detailed description in which reference is made to the accompanying drawings in which.

DETAILED DESCRIPTION OF THE PREFERRED EMBODIMENTS

Figure 1:
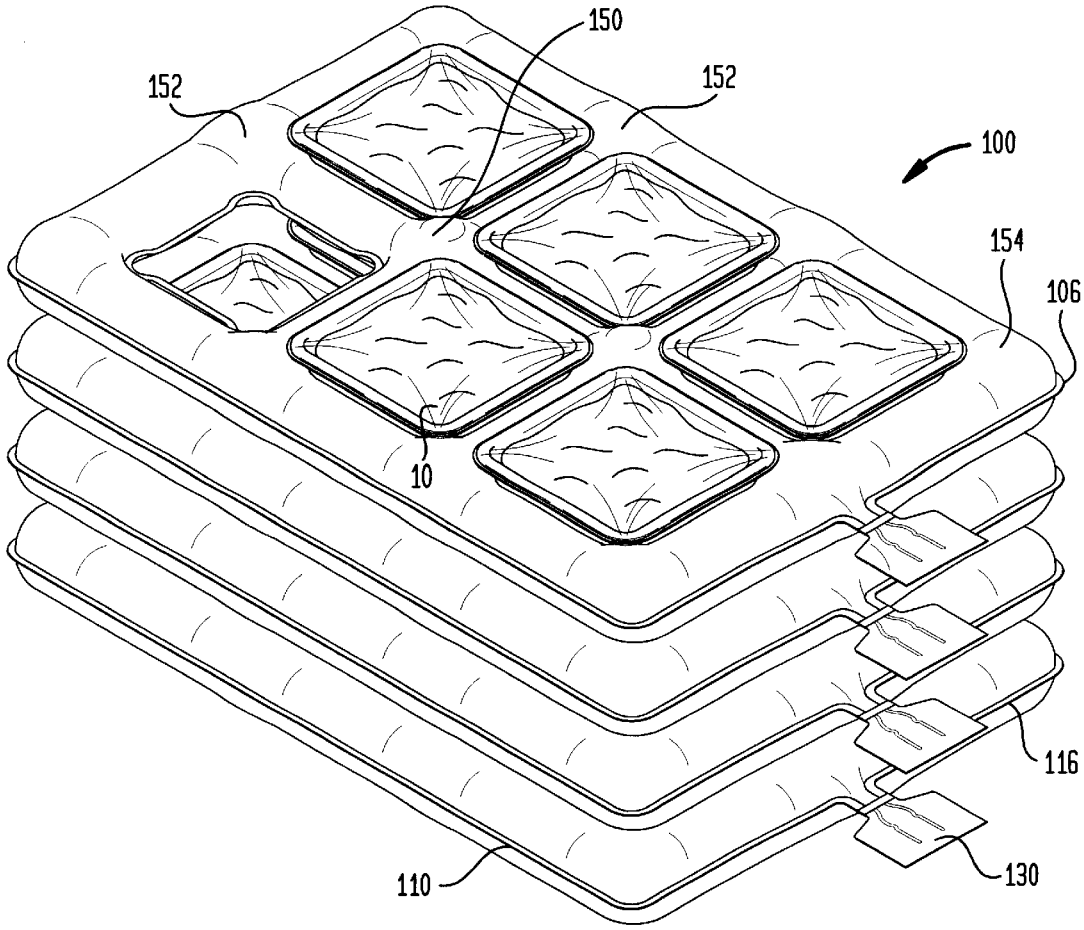
FIG. 1 is a perspective view of the packaging cushions of the present invention arranged in a plurality of layers and showing trays of products assembled in five of the six compartments available in the top layer.

Referring to the figures, a packaging cushion 100 in accordance with one embodiment of the present invention is shown in FIGS. 1–4. Packaging cushion 100 is intended for use in packaging objects, including meat and other foods, which are held in trays 10 having a bottom 12, outwardly sloping sidewalls 14, and a flange 16 projecting laterally from the top edge of the sidewalls. Flange 16 provides a surface for heat sealing one or more plastic films or laminates 18 to the tray so as to enclose the packaged object in a protected environment. Trays 10 may include, for example, conventional molded polystyrene trays, trays formed from a thermoformed plastic sheet, and the like.

Packing cushion 100 may consist of two sheets of thermoplastic material 102 and 104 sealed along sealing lines to define one or more chambers having a desired configuration which are then inflated with air or another fill medium. Sheets 102 and 104 may be formed from any number of commercially available mono- or multi-layer thermoplastic polymer films, including films comprised of polyethylene, polyurethane, or poly(ethylene-vinyl acetate). A particularly preferred thermoplastic film is a heat-sealable, gas impermeable film comprised of at least one layer of linear low density polyethylene and a gas barrier layer, such as disclosed in U.S. patent application Ser. No. 09/438,562, U.S. Pat. No. 6,244,441 entitled "Heat Sealable Barrier Film for Inflatable Packaging Cushions and Cushions Made Therefrom", which application was filed simultaneously herewith, naming Kelly Ahlgren as inventor. The disclosure of this application is incorporated by reference herein. Briefly, such films include at least one outer layer of a heat-sealable linear low density polyethylene polymer and a gas barrier layer. Additional adhesive layers and/or structural intervening layers may also be included in the laminate. The heat-sealable outer layer is sealable without the use of radio frequency energy, and exhibits good seal strength at elevated temperatures without the need for an ionizing radiation treatment.

To form cushion 100, sheets 102 and 104 are juxtaposed so that their sealable layers confront one another. The sheets are then sealed together in the region of their peripheral edges along weld line 106. The sealing may be performed by conventional techniques, for example, heat sealing. Cushion 100 has an external peripheral edge 108 which essentially describes a rectangle having sides 110 and 112 and ends 114 and 116. Sheets 102 and 104 are also sealed together along weld lines 122 to define a plurality of compartments 124 having a shape which corresponds generally to the shape of the trays 10 to be held therein. Compartments 124 may be formed with a square or rectangular configuration to accommodate the square or rectangular shape of trays 10 typically used for packaging meats and other perishable foods. However, compartments 124 are not limited to these shapes, and may be formed with round, oval, hexagonal or other shapes as desired. Moreover, the compartments in a single cushion need not all have the same size and shape. Cushion 100 may include only a single compartment 124 where only one product is to be packaged in each layer, or any number of compartments 124 depending upon the size of the cushion and the size of the objects to be held therein. Compartments 124 may be positioned in a symmetrical arrangement, such as the rows and columns depicted in the figures, or in any other positions which will maximize the number of articles which may be packaged within the area defined by a single cushion. Once compartments 124 have been formed, the portions of sheets 102 and 104 interior of weld lines 122 may be removed so that each compartment defines an opening through cushion 100. Alternatively, sheets 102 and 104 may be cut to define compartments 124 prior to being sealed together along weld lines 106 and 122. The material defining compartments 124 need not be removed entirely. Rather, the material may be slit in an "x" pattern between the opposite diagonal corners of the compartments so that it can be pivoted away along weld lines 122 to form the openings through the cushion.

Cushion 100 may be provided with a single inflation valve 130 positioned at any one of a number of locations along peripheral edge 108. Inflation valve 130 may be formed from portions of thermoplastic sheets 102 and 104 projecting outwardly from peripheral edge 108 and sealed together along spaced weld lines 132 and 134 so as to form an inlet passage 136 for an inflation nozzle. After cushion 100 has been inflated, passage 136 may be hermetically sealed, as at weld line 138, using conventional techniques, thereby sealing cushion 100 in the inflated condition. Alternatively, valve 130 may be one of the self-sealing types of valves which are known in the art.

As it exits the manufacturing process, cushion 100 is in a flat, deflated state. In this condition, cushion 100 occupies a small volume, so that a plurality of the cushions may be shipped to an end user and stored in a minimum of space. The end user may then inflate cushion 100 with a filler medium in a known fashion, and seal passage 136 to maintain the cushion in an inflated state. Although a preferred filler medium for inflating cushion 100 is air, any gas providing particularly desirable properties may be used. Furthermore, rather than air or another gas, cushion 100 may be filled with a liquid, gel, expandable foam or other substance in order to take advantage of the cushioning and shock dampening properties of these materials. The greater weight of these filler materials, however, makes them less desirable for shipping purposes.

As cushion 100 is inflated, sheets 102 and 104 bulge away from one another until the cushion has achieved its inflated shape. Continued inflation will not significantly alter the shape, but will impact the resiliency and overall flexibility of the cushion. Upon inflation, the regions of cushion 100 between adjacent compartments 124 form legs 140. Similarly, the outer periphery of cushion 100 forms legs 142 in the regions adjacent each compartment 124. When inflated, legs 140 and 142 preferably have a generally cylindrical cross-section. The distance between the weld lines 122 in adjacent compartments 124 determines the diameter of legs 140 in the inflated condition. Similarly, the distance between the weld lines 122 and the portions of weld line 106 opposed thereto determines the diameter of legs 142. Thus, if these weld lines are formed so that the distance between them is about the same, legs 140 and 142 would have similar diameters. As will be explained below, legs 140 and 142 do not have to be similar in diameter and, in fact, may purposefully be made with significantly different diameters.

Legs 140 and 142 interconnect with one another to form continuous rings extending generally in a horizontal plane and defining compartments 124. As used herein, the term "horizontal plane" refers to the plane defined by the length and width directions of cushion 100 (i.e., the plane of the page in FIG. 3). As a result of the geometry of compartments 124 and their arrangement in cushion 100, there may be a greater free expanse of materials 102 and 104 at the points where two or more legs intersect with one another than there is between the weld lines forming the legs. Hence, upon inflation of cushion 100, these points of intersection expand by a greater amount than legs 140 and 142, thereby forming bulbous regions or "nodes" which project higher than legs 140 and 142 on one face of cushion 100 and lower than legs 140 and 142 on the opposite face of cushion 100. These nodes may interfere with the flange 16 on tray 10 as the tray is inserted into compartment 124, preventing the tray from being properly seated in the compartment. By controlling the amount of free expanse of materials 102 and 104 at each node, however, the shape of the node may be altered so as to avoid any interference with the trays. Furthermore, controlling the amount of free expanse of materials 102 and 104 at each node permits adjustment of the overall thickness of cushion 100 at the nodes.

In a symmetrical arrangement in which compartments 124 are spaced substantially equidistant from one another and from the peripheral edge 108 of cushion 100, the greatest free expanse of materials 102 and 104 ordinarily would be at nodes 150, each of which defines the point of intersection of four legs 140. Without any adjustment of the free expanse of materials 102 and 104 in this region, nodes 150 would define the area in which the thickness of cushion 100 is greatest. The second greatest free expanse of materials 102 and 104 would be at the positions where two legs 142 intersect with a third leg 140, defining nodes 152; and the third greatest free expanse of materials 102 and 104 would be at nodes 154, defined by the intersection of two legs 142. Without adjustment of the free expanse of materials 102 and 104 in these regions, nodes 152 would define the second thickest areas of cushion 100, and nodes 154 would define the third thickest areas of cushion 100. Nodes 150, 152 and 154 all would have thicknesses greater than the thicknesses of legs 140 and 142.

Nodes 150, 152 and 154 act to separate the legs 140 and 142 of one cushion 100 from the legs 140 and 142 in a next adjacent cushion 100 when the cushions are stacked on top of one another. More importantly, nodes 150, 152 and 154 increase the separation distance between the trays 10 assembled in one layer and the trays 10 assembled in a next adjacent layer, and separate the legs 140 and 142 in one cushion 100 from the flanges 16 of the trays assembled in an underlying cushion. Without detracting from this separating function, it is desirable to have nodes 150, 152 and 154 all at about the same height on both the top and bottom surfaces of cushion 100 to improve the stability of the cushions when they are stacked in layers. As noted above, the height of the nodes is dependent upon the amount of free expanse of materials 102 and 104 available in a particular region. The free expanse of these materials, in turn, is related to the distance by which compartments 124 are separated from one another and from the peripheral edge 108 of the cushion, i.e., the diameters of legs 140 and 142. Thus, as the diameters of legs 140 and 142 increase, the free expanse of materials 102 and 104 at their points of intersection will increase, as will the heights of the nodes at these points of intersection. Therefore, one mechanism for controlling the height of a node is to adjust the diameter of the adjacent legs 140 and/or 142.

Figure 3:
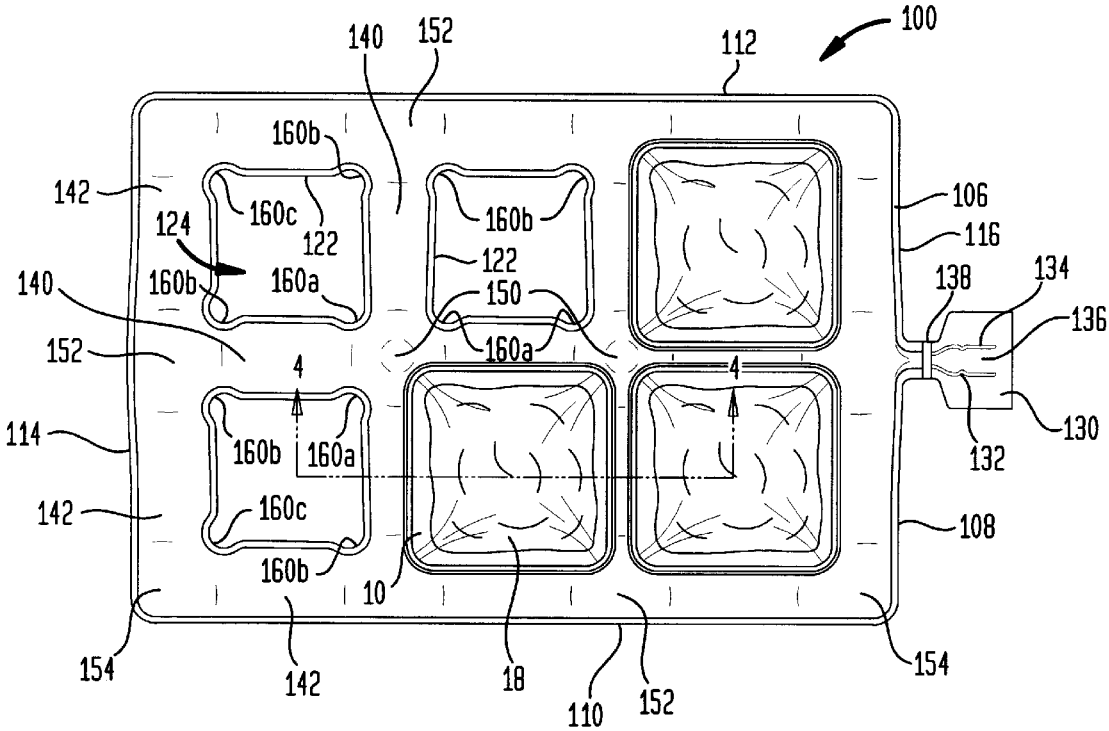
FIG. 3 is a top plan view of a packaging cushion in accordance with the present invention showing trays of products assembled in three of the six available compartments.

Referring to FIG. 3, it can be seen that the sides and ends of compartments 124 are not joined by smooth regularly curved corners. Rather, weld lines 122 define outwardly projecting dimples 160 at the corners of each compartment. Dimples 160 provide clearance for trays 10 to be inserted in compartments 124 without the flanges 16 of the trays contacting the nodes. The formation of these dimples also reduces the free expanse of materials 102 and 104 in the regions adjacent the corners of the compartments, thereby reducing the height of the nodes in those regions. The bigger the dimple formed at the corner of a compartment, the greater the reduction will be in the height of the adjacent node. Hence, once the diameters of legs 140 and 142 have been selected to provide an acceptable amount of separation between adjacent trays 10 in cushion 100 and to provide nodes 150, 152 and 154 of sufficient height, dimples 160 of an appropriate size may be formed to reduce the height of the nodes to a desired level.

Dimples 160 may all be formed with the same size, or may be formed in two or more different sizes depending upon the amount by which the height of a particular node is to be reduced, as well as the number of dimples contributing to that reduction. As noted, nodes 150 are highest on the top surface of cushion 100 and lowest on the bottom surface of cushion 100, and therefore require the greatest amount of adjustment. Moreover, it can be seen that the adjustment of each node 150 may be effected by the formation of four dimples 160*a*, each at a corner of the four compartments 124 adjacent the node, all of which dimples may be of about the same size Nodes 152 require the next amount of adjustment, but each has only two dimples 160*b* available to effect that adjustment. Consequently, dimples 160*b* may be larger in size than dimples 160*a*, and all of dimples 160*b* may be about the same size as one another. Lastly, nodes 154 require the least amount of adjustment which may be effected through a single dimple 160*c*, all of which dimples may be about equal in size. Because cushion 100 is formed from a resilient material, small variations in the overall height of nodes 150, 152 and 154 ordinarily will be accommodated by the compression of the nodes as the cushions are stacked one on top of another. Thus, it is not critical that the nodes have precisely the same height. Furthermore, it will be appreciated that dimples 160 need not be formed at a corner of a compartment 124, but may be formed at any position adjacent a node such that the formation of the dimple will reduce the free expanse of materials 102 and 104 forming the node and, hence, will reduce the height of the node. Preferably, dimples 160 are formed along weld lines 122 to simplify the manufacturing process.

Figure 2:
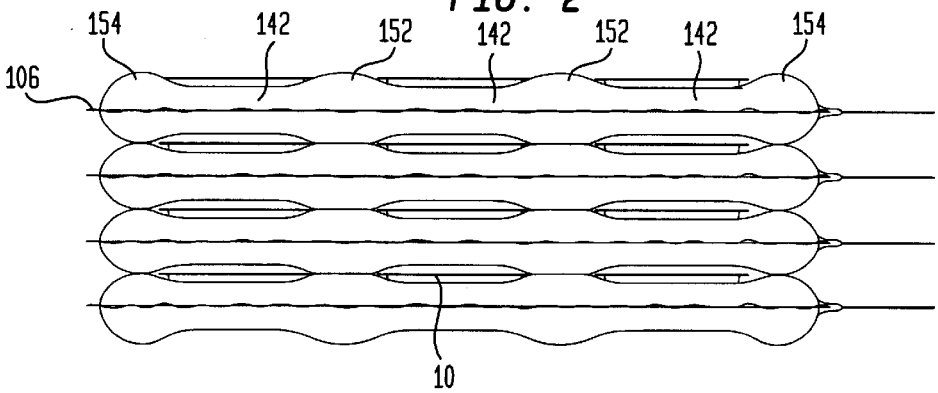
FIG. 2 is a side elevational view of the layers of packaging cushions shown in FIG. 1.
Figure 4:
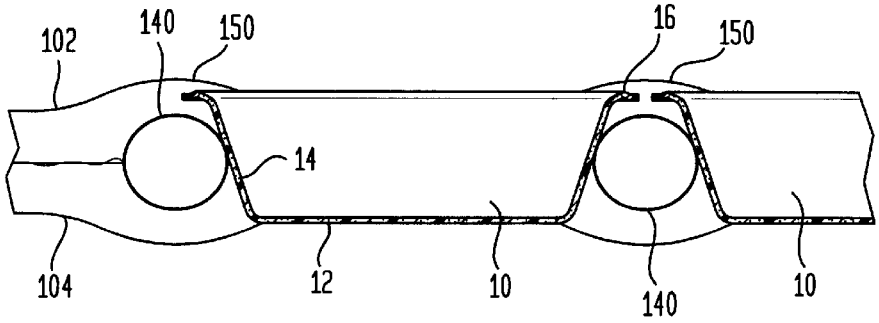
FIG. 4 is a partial cross-sectional view of the packaging cushion of FIG. 3 taken along line 4—4 thereof.

Once cushion 100 has been inflated, it may be used to hold one or more trays 10 in a suspended position. As used herein, the term "suspended position" refers to positions in which the trays or other objects are supported in one compartment so that they are spaced from the trays or other objects in other compartments and spaced from any outer containers. FIG. 4 is a cross-sectional view showing two trays 10 inserted in adjacent compartments 124 of a cushion 100. Each of compartments 124 is sized so that, when a tray is assembled therein, all of the legs 140 and 142 forming the compartment contact the tray at about the midpoint of its sidewalls 14. That is, tray 10 is inserted into a compartment 124 until it nests therein with its sidewalls 14 contacting and supported at tangent points on legs 140 and 142. In this supported position, the bottoms 12 of the trays lie higher than the lowermost surfaces of downwardly projecting nodes 150, 152 and 154. This arrangement spaces the bottoms 12 of trays 10 both from the bottom of the outer box or other packaging structure on which cushions 100 are stacked, and from the film 18 sealing the trays in any underlying cushions. This position also may support the flanges 16 of the trays at a position higher than the upper surfaces of legs 140 and 142, but lower than the upper surfaces of nodes 150, 152 and 154. Once the compartments 124 of a cushion 100 have been filled with trays 10 as desired, a second cushion 100 may be positioned over the first cushion so that the compartments and the nodes in the second cushion are in alignment in the vertical direction with the corresponding compartments and nodes in the first cushion, as shown in FIG. 2. As used herein, the term "vertical direction" refers to the direction perpendicular to the length and width directions of cushion 100. Trays 10 may then be assembled in the compartments 124 of the second cushion, and the process repeated until the desired number of cushions 100 have been stacked on top of one another.

When trays 10 are nested within compartments 124, the trays are amply protected from damage during shipment. Lateral or side-to-side protection is provided by legs 140 which keep the trays 10 separated from one another by a safe distance, and legs 142 which keep the trays spaced from the sides of an outer shipping container. Protection in the top-to-bottom or vertical direction is provided in two ways. Firstly, as noted above, the sidewalls 14 of trays 10 are supported at tangent points on legs 140 and 142. In this nested position, trays 10 are suspended with their bottoms 12 lying higher than the lowermost surfaces of downwardly projecting nodes 150, 152 and 154. As a cushion/tray assembly is dropped, the trays exert a downward force on the cushion. This force causes legs 140 and 142 to deform so that the sidewalls 14 of the trays engage an increasingly larger surface area of the legs. The deformation of the legs absorbs a portion of the impact force, hastening the deceleration of the trays and preventing the bottoms of the trays from extending beyond the lowermost surfaces of nodes 150, 152 and 154. In addition, when cushions 100 are stacked on top of one another, the downwardly projecting nodes 150, 152 and 154 on one cushion rest upon the nodes projecting upwardly from the underlying cushion. This arrangement creates an increased separation distance between the trays in the one cushion and the trays in the underlying cushion. When the assembly is dropped, each cushion/tray layer will exert a force on the underlying layer, causing the nodes between the layers to compress. This compression also absorbs a portion of the impact force, further hastening the deceleration of the trays and preventing the trays in one layer from contacting the trays in the underlying layer.

Figure 5:
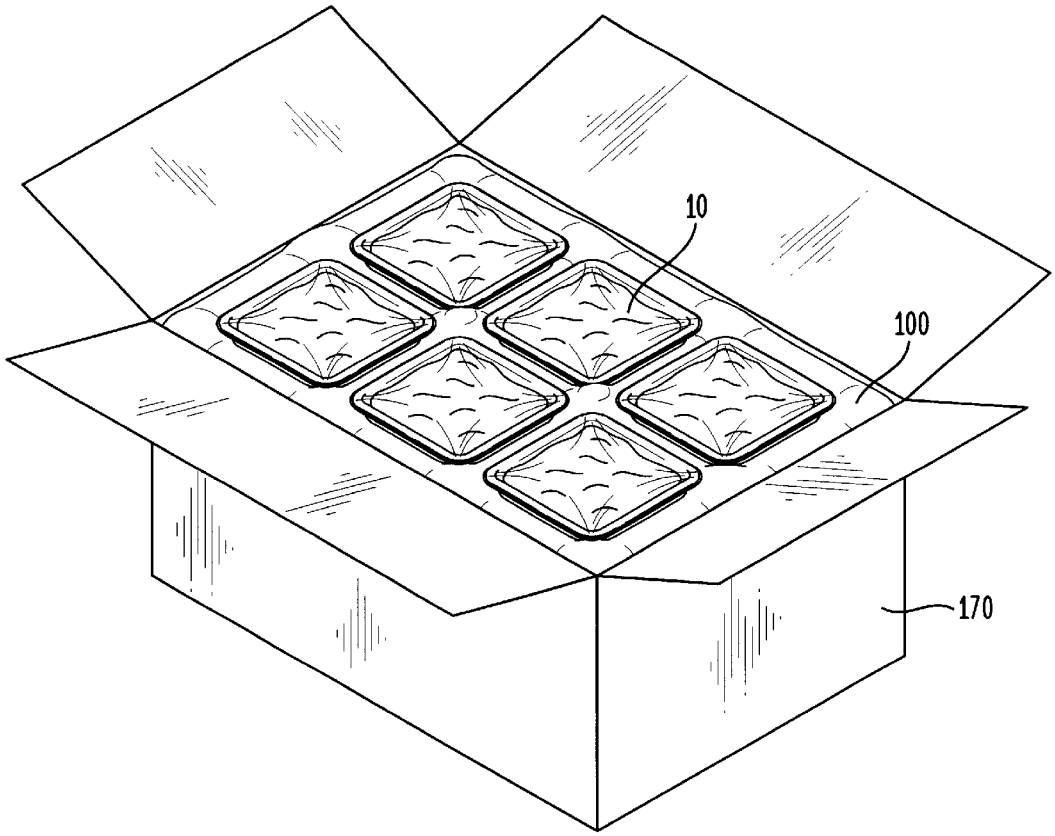
FIG. 5 is a perspective view showing the packaging cushions of FIG. 1 assembled in an outer box for shipment.

In order to ship trays 10 and their contents to another location, cushions 100 may be stacked one on top of another in an outer receptacle, such as a conventional or more highly reinforced corrugated cardboard box 170, as shown in FIG. 5. In such event, the outer peripheries of cushions 100 preferably are adapted to the shape and dimensions of the outer box so that the cushions fit snugly within the box with little or no lateral movement. In this regard, inflation valves 130 serve as a convenient grip facilitating the handling of cushions 100 as they are loaded into and unloaded from box 170. It will be appreciated that additional tabs (not shown) may be formed on the peripheral edges 108 of the cushions to provide additional grips for handling. These additional tabs need not be in the form of inflation valves. In an alternate embodiment, cushions 100 may include one or more handles (not shown) formed on the peripheral edges 108 of the cushions. The handles may be formed by attaching, such as by heat sealing, the ends of a separate plastic strap to the cushion to provide a handle into which the fingers of a hand may be inserted for grasping. Alternatively, the handles may be formed integrally with the cushion, such as by heat sealing the sheets of thermoplastic material in one or more locations adjacent the peripheral edges of the cushion in an elongated pattern, and then slitting or removing the material within the patterns to form apertures for the fingers of a hand. Once the box 170 has been filled with the desired number of cushions 100 in stacked relationship, the box may be sealed in a known fashion and shipped.

Figure 6:
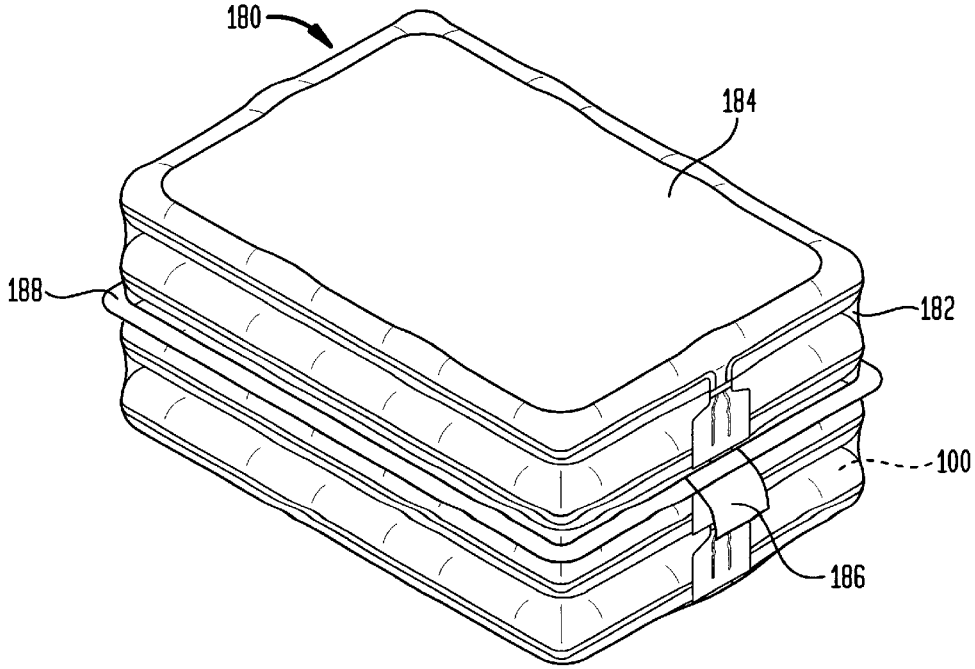
FIG. 6 is a perspective view showing the packaging cushions of FIG. 1 assembled and held in place for shipment by an outer film wrap.

As a result of the structural integrity of cushions 100 and the way in which they securely support trays 10, cushions 100 may be shipped in stacked relationship without the use of an outer box. That is, referring to FIG. 6, cushions 100 may be arranged on top of one another to form a stack 180. Stack 180 may be held in this assembled relationship by one or more passes of a high strength film, a shrink wrap film, a banding material, an adhesive tape or any other material useful for this purpose. Preferred are film materials which may be wrapped around stack 180 to completely enclose same, and which have sufficient strength and toughness to hold the cushions in assembled relationship. Particularly preferred is a polymer film 182, such as the high abuse shrink wrap film described in commonly owned U.S. Pat. No. 5,846,620, the disclosure of which is hereby incorporated by reference herein. Such films may include a first layer selected from the group consisting of linear low density polyethylene, high density polyethylene, homogeneous ethylene/alpha-olefin copolymer, polycarbonate, polyester homopolymer, polyamide, ethylene/acid copolymer, ethylene/ester copolymer, ethylene/vinyl acetate copolymer, ionomer, ethylene/carbon monoxide, very low density polyethylene, low density polyethylene, polyolefin, ethylene/propylene copolymer, ethylene/norbornene copolymer, and ethylene/styrene copolymer. The first layer may be sealed to itself or to a second layer including at least one member selected from the group consisting of linear low density polyethylene, high density polyethylene, homogeneous ethylene/alpha-olefin copolymer, polycarbonate, polyester, polyamide, ethylene/acid copolymer, ethylene/ester copolymer, ethylene/vinyl acetate copolymer, ionomer, ethylene/carbon monoxide, very low density polyethylene, low density polyethylene, polyolefin, ethylene/propylene copolymer, ethylene/propylene/diene terpolymer, ethylene/norbornene copolymer, and ethylene/styrene copolymer. Film 182 may be transparent if it is desirable to have the packaged product visible through the film, or may be pigmented to render the overwrapped assembly opaque.

Film 182 may be wrapped around the stack of cushions 100 from the bottom, up one side, across the top and then down the opposite side of the stack. The edges of the film may then be joined together, such as by heat sealing to form seam 188, to completely enclose the stack within the film. Prior to wrapping film 182 around the stack, a stabilizing sheet 184 may be positioned at the top and/or bottom of stack 180. Stabilizing sheet 184 attenuates the undulating surfaces of the cushions at the top and bottom of the stack, thereby providing a more stable surface for stacking overwrapped groups of cushions on top of one another. Stabilizing sheet 184 may be formed from a wide variety of rigid or flexible materials, including high density polyethylene, corrugated cardboard and fiberboard. A particularly preferred material is a recycled plastic sheet having a thickness of 30–100 mils.

During the step of sealing film 182 around the stack, strips of plastic or other material 186 may be inserted into seam 188 and held in place by the sealing operation. The strips of material may serve as handles for stacking, handling and carrying the overwrapped cushions. Once the overwrap process has been completed, the entire package may be subjected to a conventional heat shrink process to shrink film 182 and tighten it around cushions 100. When packaged in this manner, cushions 100 may be shipped without the use of a separate outer container.

In an alternate arrangement, film 182 may be wrapped around the outer periphery of the stack and stabilizing sheets 184 so that film 182 covers only the peripheral edges of stabilizing sheets 184 with the remainder of stabilizing sheets 184 remaining exposed. In this arrangement, stabilizing sheet 184 protects the top layer of trays 10 in the stack from loss or damage during shipment, and is therefore preferably formed from a strong, moisture resistant material.

Figure 7:
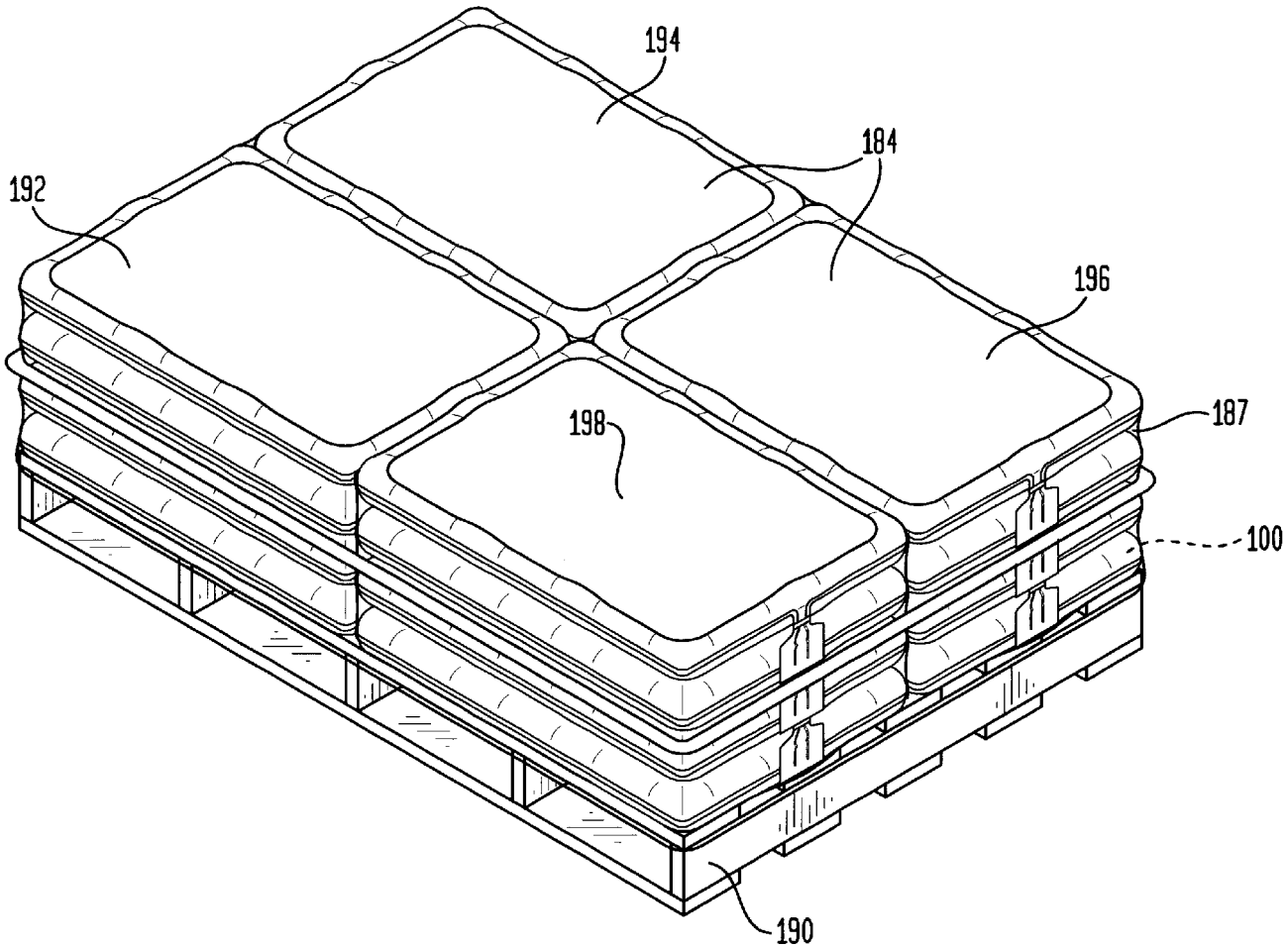
FIG. 7 is a perspective view showing the packaging cushions of FIG. 1 stacked in multiple columns and held in place for shipment by an outer film wrap.

In another arrangement, cushions 100 may be stacked in one or more columns on a pallet or other support structure, with the columns held in place for shipment by an overwrap 187 of a film, a banding material, an adhesive tape or other useful material. A system in which cushions 100 are arranged on a pallet 190 in four columns 192, 194, 196 and 198 is shown in FIG. 7. Each column may be individually wrapped with an outer film 182, with stabilizing sheets 184 at the top and/or bottom of the column as described above in connection with stacks 180. The overwrapped columns may then be placed on pallet 190 and wrapped with overwrap 187. Overwrap 187 may be the same high abuse shrink wrap film as film 182. Alternatively, columns 192, 194, 196 and 198 may be assembled on pallet 190 without being individually overwrapped. The entire assembly may then be wrapped with overwrap 187.

Figure 8:
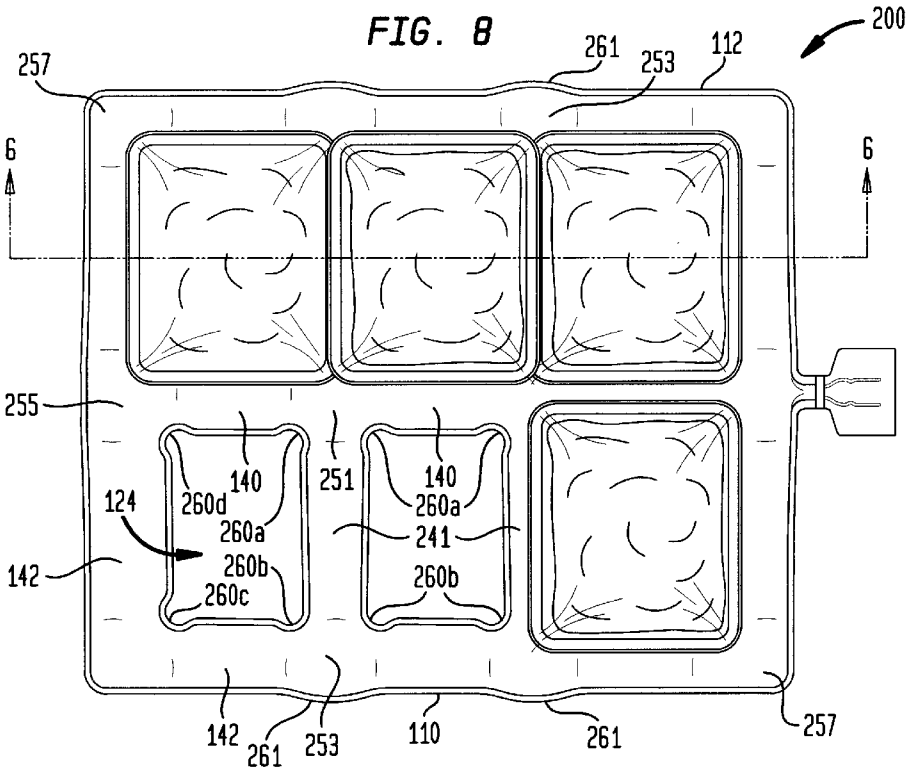
FIG. 8 is a top plan view of a packaging cushion in accordance with a second embodiment of the present invention showing trays of products assembled in four of the six available compartments.
Figure 9:
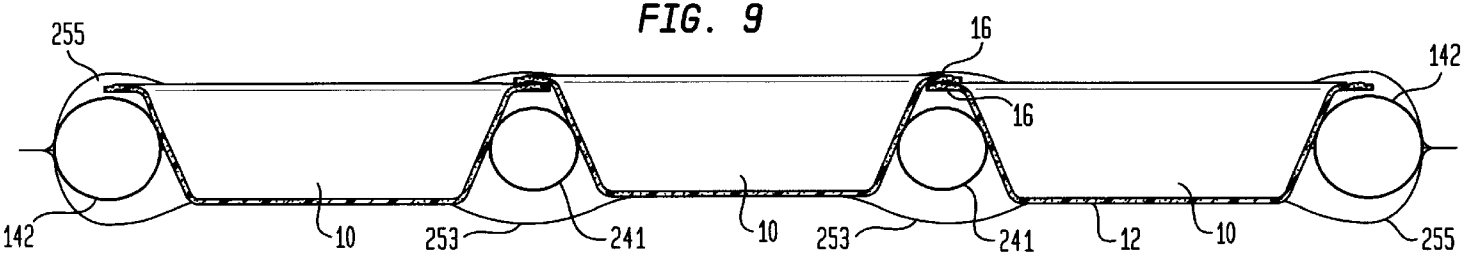
FIG. 9 is a partial cross-sectional view of the packaging cushion of FIG. 8 taken along line 9—9 thereof.

A second embodiment of a cushion 200 in accordance with the present invention is shown in FIGS. 8 and 9. Cushion 200 is configured to enable the trays 10 assembled therein to be partially overlapped with one another so that a higher density of trays 10 can be packaged in a given volume. Cushion 200 is similar in construction to cushion 100 described above. However, rather than all of the legs in the cushion being similar in diameter, the legs 241 disposed between compartments 124 and extending in the width direction of cushion 200 are substantially smaller in diameter than both the legs 142 positioned along the periphery of the cushion and the legs 140 disposed between the compartments and extending in the length direction of the cushion.

The intersection of two legs 241 with two legs 140 defines nodes 251; the intersection of one leg 241 with two legs 142 defines nodes 253; the intersection of one leg 140 with two legs 142 defines nodes 255; and the intersection of two legs 142 defines nodes 257. Since the diameter of legs 241 is smaller than the diameter of legs 140 in cushion 100 described above, the free expanse of materials 102 and 104 at nodes 251 is less than the free expanse of these materials at the corresponding nodes 150 in cushion 100 (assuming the diameter of legs 140 is the same in cushions 100 and 200). Hence, without any adjustment in their height, nodes 251 would be lower in height than unadjusted nodes 150. A further reduction in the height of nodes 251 occurs when dimples **260*a* are formed at the corners of compartments 124 adjacent the nodes for the purpose of providing clearance so that the flanges 16 of trays 10** do not contact the nodes.

As with cushion 100, a lower free expanse of materials 102 and 104 is available at the positions of nodes 253 than is available at the positions of nodes 251 such that, following the formation of dimples 260*b*, nodes 253 may be lower in height than nodes 251. Further reducing the height of nodes 251 to make the height of all the nodes about equal may have a detrimental impact on the ability of cushions 200 to keep the trays 10 in one layer separated from the trays in the next adjacent layer, particularly as cushions 200 are deformed as the shipping container is dropped or otherwise mishandled. Therefore, to make the height of nodes 251 and 253 about the same, the height of node 253 may be increased. This may be accomplished by forming bumps 261 which project outwardly from the sides 110 and 112 of cushion 200 alongside nodes 253. Bumps 261 increase the free expanse of materials 102 and 104 available at the positions of nodes 253. Thus, by controlling the size of bumps 261, the height of nodes 253 may be increased as desired. Lastly, the size of dimples 260*c* and 260*d* may be adjusted to adjust the height of their corresponding nodes 255 and 257.

FIG. 9 is a cross-sectional view showing three trays 10 inserted in adjacent compartments 124 of a cushion 200. Each of compartments 124 is sized so that, when a tray is assembled therein, all of the legs 140, 142 and 241 forming the compartment contact the tray at about the midpoint of its sidewalls 14. However, because legs 241 of cushions 200 are smaller in diameter than legs 140 of cushions 100, trays 10 in cushion 200 will be positioned closer to one another in the length direction of the cushion, and, in fact, may be positioned so that the flange 16 of the tray 10 in one compartment overlaps with the flange of the tray in an adjacent compartment. This arrangement enables cushion 200 to hold the same number of trays 10 as cushion 100, but in a smaller area. That is, cushion 200 provides a higher packaging density than cushion 100.

It will be appreciated that, since legs 140, 142 and 241 lie generally in the same horizontal plane, the axes of legs 140, 142 and 241 lie in substantially the same plane. Therefore, assuming all of compartments 124 have about the same dimensions, trays 10 will all rest at about the same height. To alleviate any damage which may be caused by the overlapping flanges 16, the central compartments 124 may be formed with slightly smaller length and width dimensions so that legs 140, 142 and 241 contact the trays 10 suspended in these compartments at lower positions on their sidewalls 14, thus supporting these trays at a slightly higher elevation than the trays are supported in the outer compartments 124. In any event, the bottoms 12 of trays 10 in their nested positions preferably lie higher than the lowermost surfaces of downwardly projecting nodes 251, 253, 255 and 257, spacing the trays in one cushion 200 from the trays 10 in an underlying cushion. In addition, the flanges 16 of the trays in their suspended positions preferably lie higher than the upper surfaces of legs 140, 142 and 241, but lower than the upper surfaces of nodes 251, 253, 255 and 257. Once the compartments 124 of cushions 200 have been filled with trays 10 as desired, cushions 200 may be packaged and shipped in the same manner as cushions 100 described above.

Cushions 200 act in a manner similar to cushions 100 to protect the trays 10 during shipment. Thus, legs 140 and 241 keep the sidewalls 14 of trays 10 separated from one another, and legs 142 keep trays 10 separated from the sides of an outer shipping container, thereby providing side-to-side protection to the trays. Protection in the vertical direction is provided by the deformation of legs 140, 142 and 241. As a cushion/tray assembly is dropped, the downward force exerted by trays 10 will deform legs 140, 142 and 241 by similar amounts, thereby maintaining approximately the same separation distance between the flanges 16 of the trays 10 nested in the center compartments 124 and the flanges 16 of the trays nested in the outer compartments 124. Additional protection in the vertical direction is supplied by the compression of nodes 251, 253, 255 and 257. Cushions 200 may be stacked on top of one another and shipped in the same fashion as described above in connection with cushions 100. That is, the cushions may be placed in an outer box and shipped, or may be wrapped with a film 182 or other material and shipped without the use of an outer box.

Figure 10:
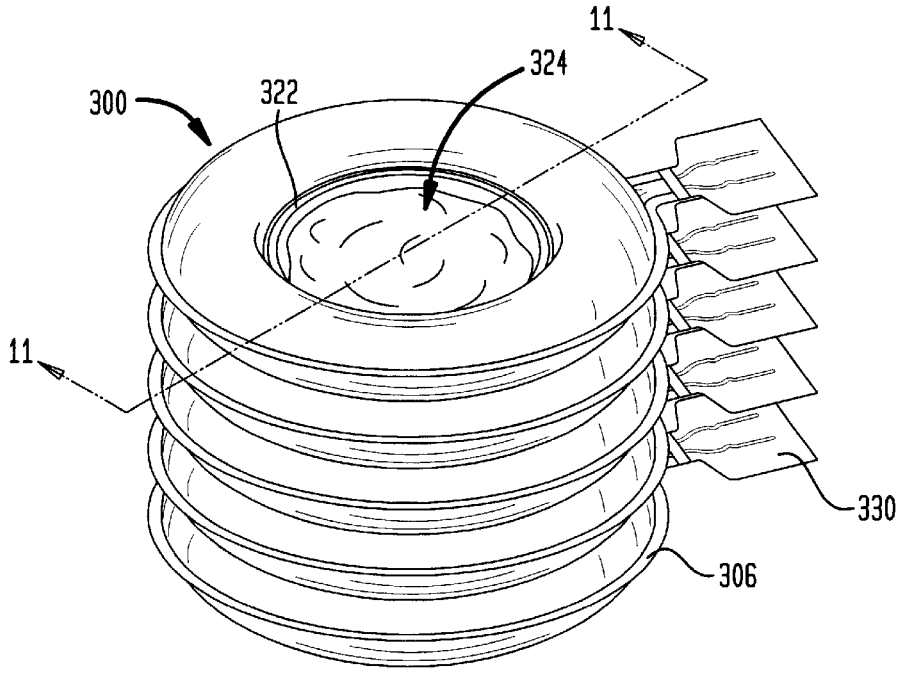
FIG. 10 is a top plan view of a packaging cushion in accordance with a third embodiment of the present invention showing products assembled for shipment therein.
Figure 11:
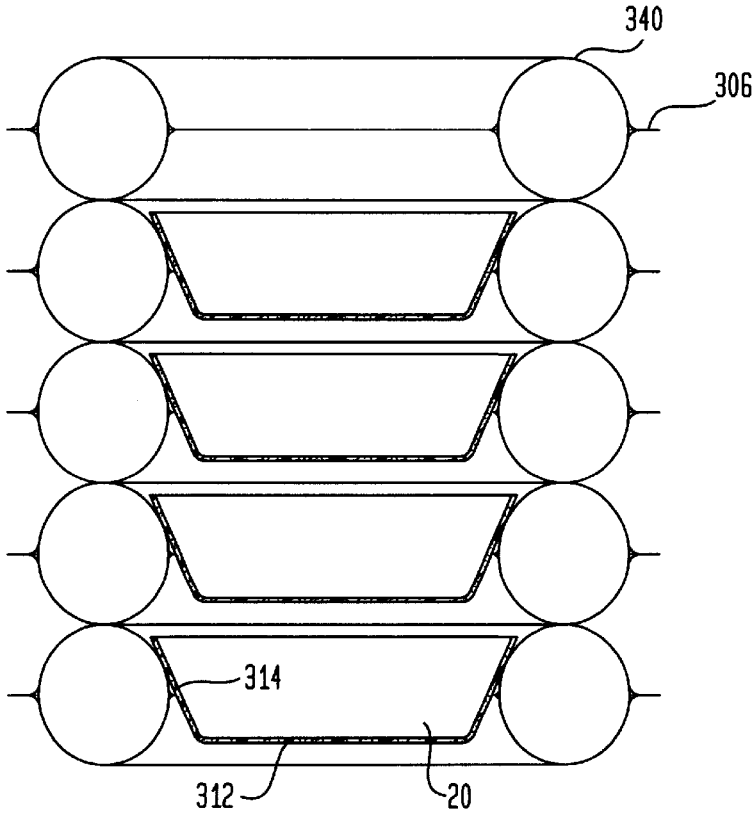
FIG. 11 is a cross-sectional view of the packaging cushion of FIG. 10 taken along line 11—11 thereof.

A third embodiment of a cushion 300 in accordance with the present invention is shown in FIGS. 10–11. Cushion 300 has a round configuration which may be desirable for the shipment of items packaged in trays 20 having a circular shape. Trays 20 have a bottom 312 and an outwardly sloping sidewall 314, but differ from trays 10 described above in that they preferably do not include a laterally projecting flange at the top edge of the sidewall.

Cushion 300 may be formed in the same manner as cushions 100 and 200 described above. That is, cushion 300 may consist of two sheets of thermoplastic material 102 and 104 sealed together in the region of their peripheral edges along weld line 306, and sealed together inwardly thereof along weld line 322 to define a single circular compartment 324. Following the formation of compartment 324, the thermoplastic material interior of weld line 322 may be removed so that compartment 324 defines an opening through cushion 300. In an alternate procedure, sheets 102 and 104 may be cut to define compartment 324 prior to being sealed together along weld lines 306 and 322. An inflation valve 330 may be formed along weld line 306 for filling the cushion with a filler medium, such as air.

In its inflated condition, cushion 300 forms a continuous ring 340 having a generally toroidal shape which defines compartment 324. One feature differentiating cushion 300 from cushions 100 and 200 described above is that cushion 300 does not form bulbous regions or nodes when inflated. That is, since the distance between weld lines 306 and 322 is substantially constant around the entirety of cushion 300, there are no regions which include a greater free expanse of materials 102 and 104, such that ring 340 has a substantially uniform diameter.

Once inflated, cushion 300 may be used to hold tray 20 in a suspended position with the sidewall 314 of the txay supported along a tangent line on ring 340. In this supported or nested position, the bottom 312 of tray 20 may lie higher than the lowermost surface of ring 340 and the upper edge of tray 20 may lie lower than the uppermost surface of ring 340. In such arrangement, the tray 20 supported by one cushion 300 will be spaced from the tray 20 supported by a next adjacent cushion when the cushions are stacked on top of one another, as can be seen in FIG. 11.

Cushions 300 may be stacked one on top of the other in any desired number of layers. The stacked layers may be assembled in an outer box or tube (not shown) for shipment, or, alternatively, a single stack or multiple stacks may be wrapped with a film 182 or other material for shipment as described above.

Although packaging cushions 100, 200 and 300 are all described above as being in the form of inflatable chambers, it will be appreciated that these cushions may be formed from any material having sufficient strength to support trays 10 or 20 along their sidewalls while absorbing impact forces so as to prevent the trays from becoming damaged. Such materials may absorb these impact forces by collapsing or deforming while preventing the trays from impacting one another or the outer container. Examples of such materials include polystyrene, expanded resinous foams and like materials which may be molded or otherwise formed to include the features of cushions 100, 200 or 300 described above. Preferred materials, however, are resilient and absorb such forces by resiliently deforming, again while preventing the trays from impacting one another or the outer container. Such resilient materials may include, for example, plastic foam materials, foam rubbers and the like, molded or otherwise formed to include the features of the cushions.

Although the foregoing describes the use of cushions 100, 200 and 300 to support trays 10 or 20 having outwardly sloping sidewalls, these cushions also may be used to support trays having sidewalls which are oriented in the vertical direction and parallel to one another. Trays having an upper flange, such as flange 16 on trays 10, may be supported by the engagement of the flange with the upper surface of the cushion. The flange may be reinforced where needed so as to have sufficient strength to support the trays without being damaged. Where the trays do not have flanges, or where the flanges have insufficient strength to support the trays, the compartments in the cushions may be sufficiently small in size to support the trays by frictional engagement. In still other arrangements, the trays may be molded so as to define support surfaces (other than upper flanges) protruding inwardly or outwardly from the sidewalls of the tray. For example, inwardly projecting channels may extend partially up the sidewalls of the tray, the ends of the channels defining inwardly protruding ledges. The compartments in the cushions may be formed with inwardly facing projections at locations corresponding to the support surfaces on the trays, whereupon the projections in the compartments of the cushions will engage the support surfaces on the trays to support the trays in suspended positions.

Figure 12:
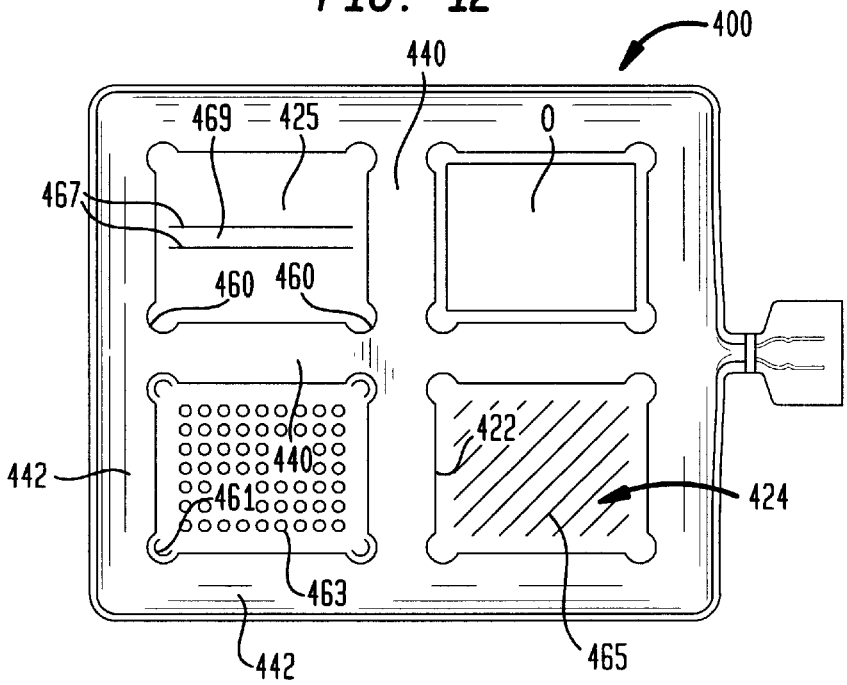
FIG. 12 is a top plan view of a packaging cushion in accordance with a fourth embodiment of the present invention showing a product assembled in one of the four available compartments.
Figure 13:
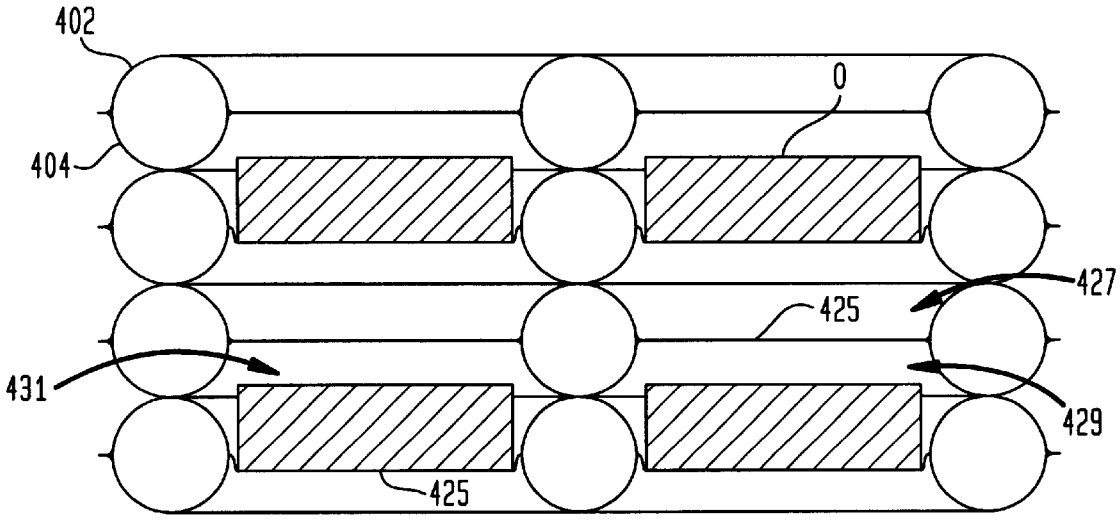
FIG. 13 is a cross-sectional view showing multiple packaging cushions of FIG. 12 in stacked relationship.
Figure 14:
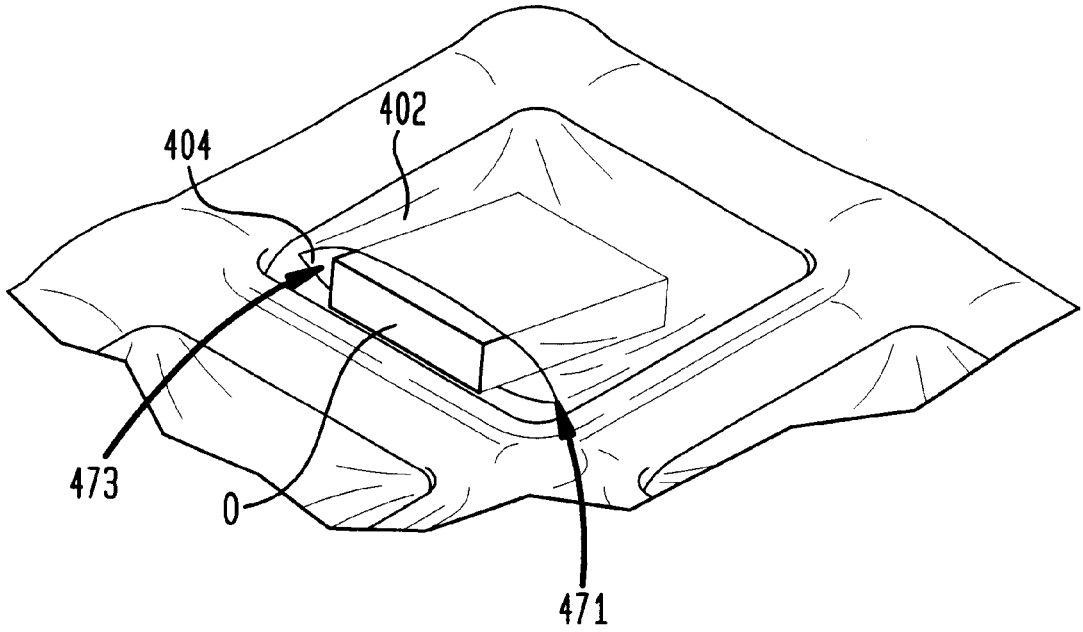
FIG. 14 is an enlarged partial perspective view showing a pouch for packaging products in the cushion of FIG. 12.

A still further embodiment of a cushion 400 in accordance with the present invention is shown in FIGS. 12 and 13. Cushions 400 may be used to package and ship a large variety of objects, including objects held in molded trays, such as trays 10 and 20, objects packaged in other materials, such as bags, pouches, films and boxes, and objects not having any individual packaging. Cushions 400 are similar in construction to cushions 100 described above, and may be formed from thermoplastic materials 402 and 404 which may be the same as materials 102 and 104. Although cushions 400 are shown to include only four compartments 424, they may include a single compartment or any number of compartments depending on the size of the cushion and the size of the objects to be held therein. Cushions 400 differ significantly from cushions 100 in that in cushions 400, the portions of materials 402 and 404 interior of weld lines 422 are not removed or slit from corner to corner, but rather are left intact after compartments 424 have been formed. These material layers form webs 425 dividing each compartment 424 into an upper pocket 427 and a lower pocket 429. As described below, when two cushions 400 are stacked on top of one another, pockets 427 and 429 cooperate with one another to surround the objects being shipped and to protect them from damage.

Referring to FIG. 13, with cushion 400 inflated, objects 0 to be packaged may be placed in one or more upper pockets 427 as desired. When positioned in a pocket, the object 0 rests upon the web 425 forming the floor of the pocket. Compartments 424, and thus pockets 427 and 429, may be sized so that the objects 0 assembled therein occupy substantially the entire surface area of the pocket, leaving little room for lateral movement of the object within the pocket. Where an object is substantially smaller than the surface area of a pocket, a padding material, fill material or other dunnage may be inserted in the pocket around the object or wrapped around the object to occupy a substantial portion of the void space.

After objects 0 have been placed in the pockets 427 of one cushion 400, a second cushion 400 may be positioned over the first cushion so that the lower pockets 429 in the second cushion are positioned over the objects in the first cushion. In this manner, each lower pocket 429 in the second cushion cooperates with a confronting upper pocket 427 in the first cushion to define an enclosed cell 431 which entirely surrounds object 0. It will be appreciated that the height of cells 431 between the webs 425 in the second cushion and the webs 425 in the first cushion is dependent upon the diameter of legs 440 and 442 defining compartments 424, as well as the height of any nodes formed at the intersections of legs 440 and 442. Hence, by controlling the diameter of legs 440 and 442 and the formation of nodes, cells 431 can be formed with a height which is similar to the height of the objects 0 being packaged therein.

As with cushions 100, the height of any nodes formed at the intersections of legs 440 and 442 may be controlled by the formation of dimples 460 at the corners of compartments 424. Preferably, dimples 460 are sized so that cushions 400 have nodes which are very small in height or, more preferably, no nodes at all. That is, to optimize the protection of objects 0, it is desirable to minimize the height of the nodes so as to minimize any gaps between confronting cushions which could enable the objects to escape from the cells 431 in which they are held.

The presence of dimples 460 also permits larger rectangular objects to be held in compartments 424 without increasing the length and width of the compartments. In this regard, dimples 460 provide relief at the corners of the compartments to accommodate the corners of rectangular objects.

The shock absorbing and protective performance of cushions 400 may be improved by forming slits 461 in webs 425 at the corners of compartments 424, preferably within the area of dimples 460. Since each web 425 is constrained in two directions at the corners of the compartments, the stress in the webs is greatest at these points. By forming slits 461, the stress in web 425 is more uniformly distributed, and the web is able to absorb a greater degree of shock without failure. Where desired, web 425 may be made more yielding, such as by forming a plurality of apertures 463 in the web or a plurality of slits 465 in the web in the length, width or diagonal directions of the compartment.

Where the height of cells 431 is similar to the height of objects 0, there will be little, if any, deflection of webs 425 when two cushions 400 are assembled around the object, depending, of course, on the weight of the objects. Alternatively, the diameters of legs 440 and 442 may be sized so that the height of cells 431 is smaller than the height of objects 0 by a selected amount. In this scenario, when two cushions 400 are assembled around an object 0, the webs 425 therein will be deflected away from one another, such that the tension in the webs will hold the object firmly therebetween.

In certain situations, the objects 0 being packaged in cells 431 may be so thin that it would be impractical to make the height of the cells similar to or smaller than the height of the objects. In those situations, there ordinarily would be a relatively large void space between the object 0 and the web 425 in the overlying pocket 429. This void space may be filled with conventional dunnage to prevent the object 0 from bouncing around within the cell. Alternatively, the webs 425 in the lower cushion 400 may be formed with one or more slits which may be used to hold the object 0 in place. Slits 461, for example, may be used for this purpose. The corners of object 0 may be inserted into slits 461, whereupon the object will be held against the web. In a variant of this arrangement, a pair of parallel slits 467 may form a central strip 469 in the length, width or a diagonal direction in compartments 424. The object 0 to be packaged may be inserted and held in place between web 425 and strip 469. In a still further arrangement, a single slit may be formed in one of the layers of materials 402 and 404 forming a web 425, but not in the other layer. For example, a slit 471 may be formed in material layer 402, but not in material layer 404. Slit 471 would provide access to the pouch 473 formed in web 425 between layers 402 and 404. Object 0 may be inserted through slit 471 to be held in pouch 473 during shipping.

Ordinarily, two cushions 400 would be used to package only a single layer of objects 0 within an outer box or other container. Where it is desired to package a second layer of objects 0 in the same container, such objects would ordinarily be packaged in the cells 431 defined between third and fourth cushions 400 stacked above the first and second cushions. Additional cushions may be added to the stack and filled with objects 0 in the same pattern. Typically, no objects 0 would be packaged in the cells 431 defined between alternating cushions, such as the second and third cushions, in those cases in which the objects occupy substantially the entire height of the cells. However, where the objects being packaged have a relatively low height relative to the height of cells 431 such that there is a large void space between the objects and the webs 425 in the overlying pockets 429, the objects may be packaged in the cells defined between each adjacent pair of cushions, i.e., between the first and second cushions, the second and third cushions, the third and fourth cushions, etc.

When objects 0 are packaged between two cushions 400, the cushions isolate the objects within cells 431 and protect them from damage. Thus, legs 440 and 442 define the sides of cells 431, separating the objects from one another and from the sides of an outer shipping container, providing side-to-side protection during shipping. Protection in the top-to-bottom direction is provided both by legs 440 and 442 and by webs 425. If the shipping container is dropped, legs 440 and 442 will compress, absorbing a portion of the impact force. In addition, webs 425 may stretch, absorbing a further component of the impact force. The combined action of the legs and the webs retains the packaged objects in a suspended position within the shipping container and prevents impact damage. Cushions 400 may be stacked on top of one another and shipped in the same way as the previously described cushions. In other words, cushions 400 may be placed in a conventional outer box or other container and shipped, or they may be wrapped with a film 182 or other material and shipped without the use of an outer box.

As with cushions 100, 200 and 300 described above, cushion 400 may be formed from any material having sufficient strength to support objects 0 within cells 431 while absorbing the forces which may be exerted thereon during shipping. Suitable materials may include, for example, polystyrene, expanded resinous foam and like materials, which absorb impact forces by collapsing or deforming while preventing the objects from impacting one another or the outer container. These materials may be molded or otherwise formed to include the features of cushion 400 described above. Preferred materials, however, are resilient and absorb such forces by resiliently deforming by a small amount, again while preventing the objects from impacting one another or the outer container. Examples of such resilient materials include plastic foam materials, foam rubbers and the like.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A packaging cushion for holding at least one tray having a bottom, outwardly-sloping sidewalls and a top edge, said cushion comprising a plurality of ring elements formed from a resilient material and extending generally in a horizontal plane, said ring elements defining a plurality of openings, at least one of said ring elements defining at least two of said openings, said ring elements having top and bottom surfaces and having interior side surfaces facing toward said openings, said openings extending entirely through said cushion from said top surfaces of said ring elements to said bottom surfaces of said ring elements, said interior side surfaces of said ring elements being adapted to engage the sidewalls of the at least one tray to support the tray in a suspended position, each of said ring elements including a hollow chamber at least partially filled with a filler medium, at least one of said chambers being in flow communication with another one of said chambers, said ring elements defining one or more rows of said openings extending between one end of said cushion and another end of said cushion opposite said one end, said openings in each of said rows being separated by a ring element of a first group, said ring elements having a cross-sectional size, said cross-sectional size of each of said ring elements in said first group being about the same; and a plurality of upper nodes projecting upwardly from said ring elements at spaced-apart locations, said upper nodes having top surfaces disposed higher than said top surfaces of said ring elements, said top surfaces of said upper nodes being at substantially the same height.

2. The packaging cushion as claimed in claim 1, further comprising a plurality of lower nodes projecting downwardly from said ring elements at spaced-apart locations, said lower nodes having bottom surfaces disposed lower than said bottom surfaces of said ring elements, said ring elements being adapted to engage the sidewalls of the at least one tray so that the bottom of the tray lies lower than said bottom surfaces of said ring elements and higher than said bottom surfaces of said lower nodes.

3. The packaging cushion as claimed in claim 2, wherein said bottom surfaces of said lower nodes are at substantially the same height.

4. The packaging cushion as claimed in claim 2, wherein each one of said upper nodes is substantially aligned over one of said lower nodes to define a plurality of node pairs.

5. The packaging cushion as claimed in claim 4, wherein, for each one of said node pairs, said top surface of said upper node is spaced from said bottom surface of said lower node by a separation distance, said separation distance for each one of said node pairs being about the same.

6. The packaging cushion as claimed in claim 1, wherein said interior side surfaces of said ring elements have a substantially cylindrical contour.

7. The packaging cushion as claimed in claim 1, wherein said cross-sectional size of each one of said ring elements is about the same.

8. The packaging cushion as claimed in claim 1, wherein said cross-sectional size of said first group of said ring elements is substantially less than said cross-sectional size of a second group of said ring elements.

9. The packaging cushion as claimed in claim 1, wherein said filler medium comprises air.

10. The packaging cushion as claimed in claim 1, further comprising a valve member defining an opening for supplying said filler medium to an interior of said chamber.

11. A packaging cushion for holding at least one object, comprising a plurality of ring elements formed from a resilient material and extending generally in a horizontal plane, said ring elements having top and bottom surfaces and defining a plurality of compartments extending entirely through said cushion from said top surfaces of said ring elements to said bottom surfaces of said ring elements, at least one of said ring elements defining at least two of said compartments, each of said ring elements including a hollow chamber at least partially filled with a filler medium, at least one of said chambers being in flow communication with another one of said chambers, said ring elements defining one or more rows of said compartments extending between one end of said cushion and another end of said cushion opposite said one end, said compartments in each of said rows being separated by a ring element of a first group, said ring elements having a cross-sectional size, said cross-sectional size of each of said ring elements in said first group being about the same;

a plurality of upper nodes projecting upwardly from said ring elements at spaced-apart locations, said upper nodes having top surfaces disposed higher than said top surfaces of said ring elements, said top surfaces of said upper nodes being at substantially the same height; and means in said plurality of compartments for supporting the object in a suspended position in which the object is higher than said bottom surfaces of said ring elements.

12. A packaging assembly, comprising a cushion having one or more ring elements extending generally in a horizontal plane, said ring elements defining one or more openings, said ring elements having top and bottom surfaces and interior side surfaces facing toward said one or more openings, said interior side surfaces defining surfaces that are curved such that said openings are larger adjacent said top and bottom surfaces than at a midpoint between said top and bottom surfaces;

at least one tray having a bottom, a top edge, and outwardly-sloping sidewalls between said bottom and said top edge, said at least one tray being assembled in one of said openings with said interior side surfaces of said ring elements engaging said sidewalls of said tray to support said tray in a suspended position.

13. The packaging assembly as claimed in claim 12, further comprising a plurality of upper nodes projecting upwardly from said ring elements at spaced-apart locations, said upper nodes having top surfaces disposed higher than said top surfaces of said ring elements, said top edge of said tray in said suspended position being higher than said top surfaces of said ring elements and lower than said top surfaces of said upper nodes.

14. The packaging structure as claimed in claim 12, wherein said ring elements have a cross-sectional size, said cross-sectional size of each one of said ring elements being about the same.

15. The packaging assembly as claimed in claim 12, wherein said ring elements have a cross-sectional size, said cross-sectional size of a first group of said ring elements being substantially less than said cross-sectional size of a second group of said ring elements.

16. The packaging assembly as claimed in claim 15, wherein said first group of ring elements are disposed between adjacent ones of said openings.

17. The packaging assembly as claimed in claim 16, further comprising a plurality of trays, each tray having a bottom, outwardly-sloping sidewalls, a top edge and a flange projecting outwardly from said top edge, said plurality of trays being assembled in said openings so that said flange of one of said trays overlaps with said flange of an adjacent one of said trays.

18. The packaging assembly as claimed in claim 12, wherein said ring elements define one or more rows of said openings, said openings in each of said rows being separated by a first group of said ring elements.

19. The packaging assembly as claimed in claim 18, wherein said ring elements define two or more rows of said openings, said openings in one of said rows being separated from said openings in another one of said rows by a second group of said ring elements, said ring elements in said second group having a cross-sectional size which is greater than a cross-sectional size of said ring elements in said first group.

20. The packaging assembly as claimed in claim 12, wherein said ring elements are formed from a resilient material.

21. The packaging assembly as claimed in claim 20, wherein said ring elements include a hollow chamber at least partially filled with a filler medium.

22. A method of packaging at least one tray having a bottom, a top edge, and outwardly-sloping sidewalls between said bottom and said top edge, said method comprising providing a cushion having one or more ring elements extending generally in a horizontal plane, said ring elements defining one or more openings, said ring elements having top and bottom surfaces and interior side surfaces facing toward said one or more openings, said interior side surfaces defining surfaces that are curved such that said openings are larger adjacent said top and bottom surfaces than at a midpoint between said top and bottom surfaces; and positioning said at least one tray in one of said openings to form an assembly in which said interior side surfaces of said ring elements engage said sidewalls of said tray to support said tray in a suspended position.

23. The packaging method as claimed in claim 22, wherein said step of providing said cushion includes the step of providing said cushion with a plurality of upper nodes projecting upwardly from said ring elements at spaced-apart locations, said upper nodes having top surfaces disposed higher than said top surfaces of said ring elements, and wherein said positioning step includes the step of positioning said tray so that said top edge of said tray in said suspended position lies higher than said top surfaces of said ring elements and lower than said top surfaces of said upper nodes.

24. The packaging method as claimed in claim 23, wherein said step of providing said cushion includes the step of providing said cushion with a plurality of lower nodes projecting downwardly from said ring elements at spaced-apart locations, said lower nodes having bottom surfaces disposed lower than said bottom surfaces of said ring elements, and wherein said positioning step includes the step of positioning said tray so that said bottom of said tray in said suspended position lies lower than said bottom surfaces of said ring elements and higher than said bottom surfaces of said lower nodes.

25. The packaging method as claimed in claim 22, wherein said ring elements are formed from a resilient material.

26. The packaging method as claimed in claim 25, wherein said ring elements include a hollow chamber.

27. The packaging method as claimed in claim 26, further comprising the step of at least partially filling said hollow chamber with a filler medium.

28. The packaging method as claimed in claim 22, further comprising the step of at least partially surrounding said assembly with an outer container to hold said at least one tray and said cushion in assembled relationship.

29. The packaging method as claimed in claim 28, wherein said surrounding step includes the step of wrapping a film material around said assembly.

30. The packaging method as claimed in claim 29, further comprising the step of connecting at least one handle to said film material.

31. A packaging cushion for holding at least one tray having a bottom, outwardly sloping side walls and a top edge, said cushion comprising a plurality of ring elements formed from a resilient material and extending generally in a horizontal plane, said ring elements defining a plurality of openings, at least one of said ring elements defining at least two of said openings, said ring elements having top and bottom surfaces and having interior side surfaces facing toward said openings, said interior side surfaces of said ring elements being adapted to engage the side walls of the at least one tray to support the tray in a suspended position, each of said ring elements including a hollow chamber at least partially filled with a filler medium, at least one of said chambers being in flow communication with another one of said chambers, said ring elements defining two or more rows of said openings, said openings in each of said rows being separated by a ring element of a first group, said openings in one of said rows being separated from said openings in another one of said rows by a second group of said ring elements, said ring elements having a cross-sectional size, said cross-sectional size of each of said ring elements in said first group being about the same, and said cross-sectional size of each of said ring elements in said second group being greater than said cross-sectional size of said ring elements in said first group.

32. A packaging assembly, comprising a cushion having one or more ring elements extending generally in a horizontal plane, said ring elements defining one or more openings, said ring elements having top and bottom surfaces and having interior side surfaces facing toward said one or more openings;

a plurality of upper nodes projecting upwardly from said ring elements at spaced-apart locations, said upper nodes having top surfaces disposed higher than said top surfaces of said ring elements; and at least one tray having a bottom, a top edge, and outwardly-sloping side walls between said bottom and said top edge, said at least one tray being assembled in one of said openings with said interior side surfaces of said ring elements engaging said side walls of said tray to support said tray in a suspended position, said top edge of said tray in said suspended position being higher than said top surfaces of said ring elements and lower than said top surfaces of said upper nodes.

33. The packaging assembly as claimed in claim 32, wherein said top surfaces of said upper nodes are at substantially the same height.

34. The packaging assembly as claimed in claim 32, further comprising a plurality of lower nodes projecting downwardly from said ring elements at spaced-apart locations, said lower nodes having bottom surfaces disposed lower than said bottom surfaces of said ring elements, said at least one tray being assembled in said one of said openings with said ring elements engaging said sidewalls of said tray so that said bottom of said tray lies lower than said bottom surfaces of said ring elements and higher than said bottom surfaces of said lower nodes.

35. The packaging assembly as claimed in claim 34, wherein said bottom surfaces of said lower nodes are at substantially the same height.

36. The packaging assembly as claimed in claim 34, wherein each one of said upper nodes is substantially aligned over one of said lower nodes to define a plurality of node pairs.

37. The packaging assembly as claimed in claim 36, wherein, for each one of said node pairs, said top surface of said upper node is spaced from said bottom surface of said lower node by a separation distance, said separation distance for each one of said node pairs being about the same.

38. A packaging assembly, comprising a cushion having one or more ring elements extending generally in a horizontal plane, said ring elements defining one or more openings, said ring elements having top and bottom surfaces and having interior side surfaces facing toward said one or more openings, said ring elements having a cross-sectional size, said cross-sectional size of a first group of said ring elements being substantially less than said cross-sectional size of a second group of said ring elements, said first group of ring elements being disposed between adjacent ones of said openings; and a plurality of trays, each tray having a bottom, a top edge, outwardly-sloping sidewalls between said bottom and said top edge and a flange projecting outwardly from said top edge, said plurality of trays being assembled in said openings so that said interior side surfaces of said ring elements engage said side walls of said trays to support said trays in suspended positions with said flange of one of said trays overlapping said flange of an adjacent one of said trays.

39. A packaging assembly, comprising a cushion having one or more ring elements extending generally in a horizontal plane, said ring elements defining one or more openings, said ring elements having top and bottom surfaces and having interior side surfaces facing towards said one or more openings, each of said ring elements being formed from a resilient material and including a hollow chamber at least partially filled with a filler medium; and at least one tray having a bottom, a top edge, and outwardly-sloping side walls between said bottom and said top edge, said at least one tray being assembled in one of said openings with said interior side surfaces of said ring elements engaging said side walls of said tray to support said tray in a suspended position.

40. The packaging assembly as claimed in claim 39, wherein said filler medium comprises air.

41. The packaging assembly as claimed in claim 39, further comprising a valve member defining an opening for supplying said filler medium to an interior of said chamber.

42. A method of packaging at least one tray having a bottom, a top edge, and outwardly-sloping side walls between said bottom and said top edge, said method comprising providing a cushion having one or more ring elements extending generally in a horizontal plane, said ring elements defining one or more openings, said ring elements having top and bottom surfaces and interior side surfaces facing toward said one or more openings, said cushion having a plurality of upper nodes projecting upwardly from said ring elements at spaced-apart locations, said upper nodes having top surfaces disposed higher than said top surfaces of said ring elements; and positioning said at least one tray in one of said openings to form an assembly in which said interior side surfaces of said ring elements engage said side walls of said tray to support said tray in a suspended position in which said top edge of said tray lies higher than said top surfaces of said ring elements and lower than said top surfaces of said upper nodes.

43. A method of packaging at least one tray having a bottom, a top edge, and outwardly-sloping side walls between said bottom and said top edge, said method comprising providing a cushion having one or more ring elements extending generally in a horizontal plane, said ring elements defining one or more openings, said ring elements having top and bottom surfaces and interior side surfaces facing toward said one or more openings, said ring elements being formed from a resilient material and including a hollow chamber;

at least partially filling said hollow chamber with a filler medium; and positioning said at least one tray in one of said openings to form an assembly in which said interior side surfaces of said ring elements engage said side walls of said tray to support said tray in a suspended position.

44. A method of packaging at least one tray having a bottom, a top edge, and outwardly-sloping side walls between said bottom and said top edge, said method comprising providing a cushion having one or more ring elements extending generally in a horizontal plane, said ring elements defining one or more openings, said ring elements having top and bottom surfaces and interior side surfaces facing toward said one or more openings;

positioning said at least one tray in one of said openings to form an assembly in which said interior side surfaces of said ring elements engage said side walls of said tray to support said tray in a suspended position;

wrapping a film material around said assembly to at least partially surround said assembly with said film material to hold said at least one tray and said cushion in assembled relationship; and connecting at least one handle to said film material.

* * * * *